United States Patent [19]

Nelson

[11] 4,377,969

[45] Mar. 29, 1983

[54] AUTOMATIC FUME HOOD AIRFLOW CONTROL

[75] Inventor: Laurence N. Nelson, Onsted, Mich.

[73] Assignee: Kewaunee Scientific Equipment Corp., Adrian, Mich.

[21] Appl. No.: 214,175

[22] Filed: Dec. 8, 1980

[51] Int. Cl.[3] ..... F23J 11/00

[52] U.S. Cl. ..... 98/115 LH

[58] Field of Search ..... 98/115 R, 115 LH; 55/DIG. 18

[56] References Cited

U.S. PATENT DOCUMENTS

| | | | |
|---|---|---|---|
| 3,025,780 | 3/1962 | Russell . | |
| 3,403,474 | 10/1968 | Spasoff . | |
| 3,531,895 | 10/1970 | Appell . | |
| 3,714,737 | 2/1973 | Fillion et al. . | |
| 3,752,056 | 8/1973 | Chamberlin et al. | 98/115 LH |
| 3,850,086 | 11/1974 | Walter et al. | 98/115 LH |
| 3,934,496 | 1/1976 | Turko . | |
| 3,938,282 | 2/1976 | Goyal . | |
| 4,050,189 | 9/1977 | Peterson . | |
| 4,150,606 | 4/1979 | Nelson . | |
| 4,155,289 | 5/1979 | Garriss | 98/115 LH |
| 4,160,407 | 7/1979 | Duym | 98/115 R |
| 4,215,627 | 8/1980 | Garriss | 98/115 LH |

FOREIGN PATENT DOCUMENTS

| | | | |
|---|---|---|---|
| 283540 | 6/1971 | U.S.S.R. | 98/115 LH |

*Primary Examiner*—Albert J. Makay
*Assistant Examiner*—Harold Joyce
*Attorney, Agent, or Firm*—Hill, Van Santen, Steadman, Chiara & Simpson

[57] ABSTRACT

Laboratory fume hoods with open hood faces closed by door sash are provided with an automatic airflow control regulating the quantity of air drawn into the hood in response to movement of the door sash for maintaining a controlled velocity of air through the hood face to keep fumes within the hood while reducing energy requirements for either heating or cooling the air to maintain safe operation. The open hood face is controlled by a vertically slidable sash or window counterbalanced by a weight that is connected to the sash by a cable which moves directly proportional to the movement of the sash. This cable actuates mechanism for opening and closing a damper in the exhaust system for the fume hood. In one embodiment, the cable drives a pressure regulator which controls an air motor to rotate the damper. In other embodiments the cable may drive reduction gear to the damper or control a servo motor which drives the damper. A plurality of fume hoods may be connected to a single constant static pressure exhaust system with each hood having its own sash controlled damper to maintain an air flow velocity that will provide safe operation of each hood with a minimum energy consumption.

1 Claim, 8 Drawing Figures

FIG 3
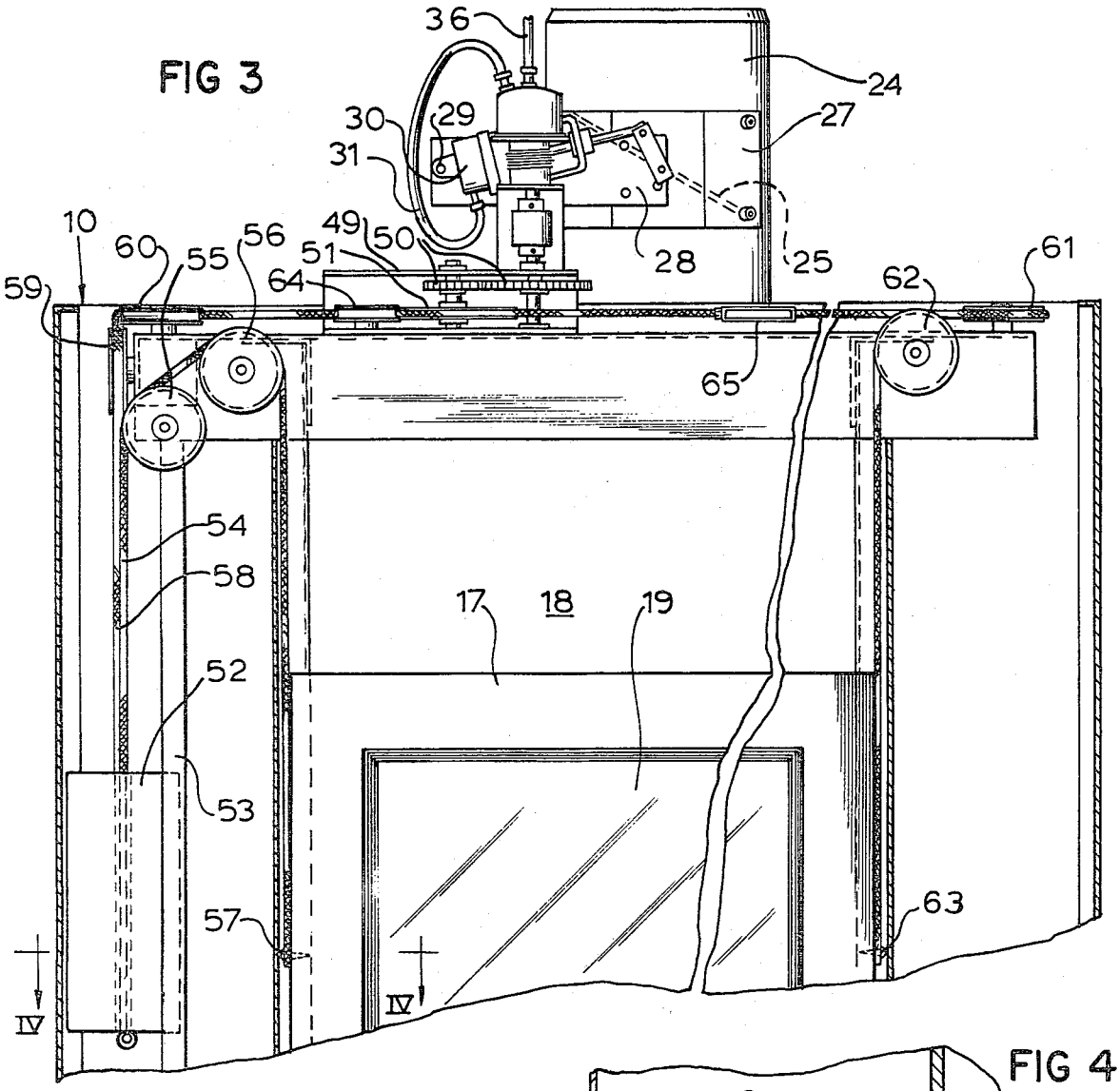
FIG 4
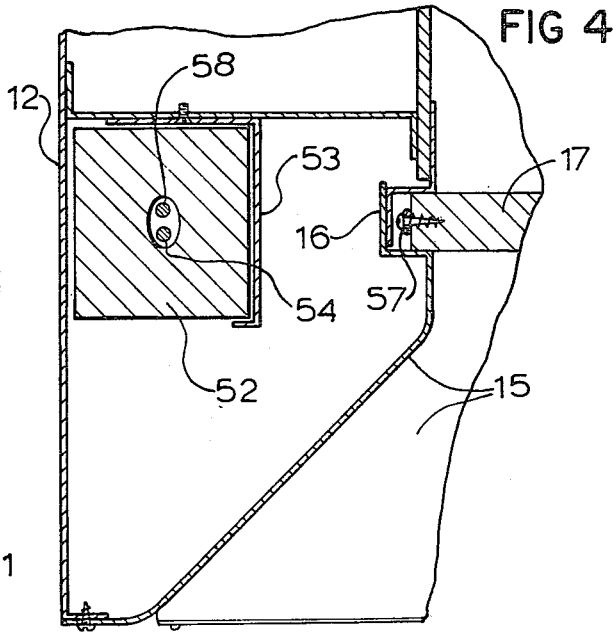
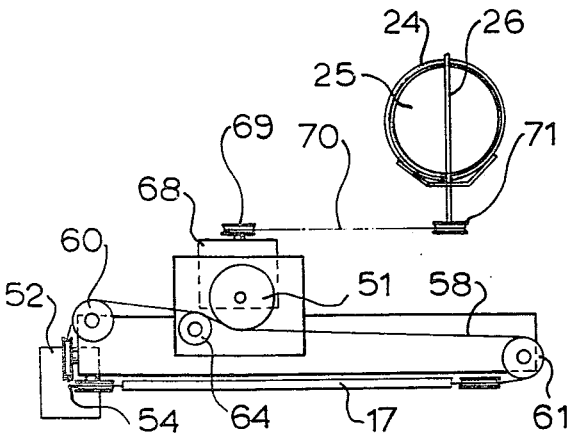
FIG 5

AUTOMATIC FUME HOOD AIRFLOW CONTROL

BACKGROUND OF THE INVENTION

1. Field of the Invention

This invention relates to the art of controlling air flow through door sash equipped apparatus in proportion to the degree of opening of the sash and particularly deals with sash operated damper controls for laboratory fume hoods.

2. Prior Art

In my prior U.S. Pat. No. 4,150,606 granted Apr. 24, 1979, entitled "Automatic Laboratory Fume Hood Sash Operator", I have described and claimed an attachment for laboratory fume hood structures which will open and close the movable sash member thereof. In this patent, switches, triggered by movement of the sash will drive an exhaust blower at high speeds when the sash is open, at low speeds when the sash is closed and may also drive an auxiliary blower when the sash is open. Proportioning of air flow between fully opened and fully closed sash positions is not provided. It would be an improvement in the art to control the exhaust system in proportion to the degree of opening of the door sash and to provide an individual damper control for each fume hood in an exhaust system serving an individual hood or in an exhaust system serving a plurality of fume hoods.

SUMMARY OF THE INVENTION

This invention now provides an airflow control for laboratory fume hoods and the like responsive to movement of the door sash so that as the door is opened, a damper in the exhaust system serving the hood is proportionally opened as the door is opened and proportionately closed as the door is closed for maintaining a controlled velocity of air through the hood to keep fumes within the hood while at the same time minimizing energy requirements. The proportional openings and closings need not be linear or direct proportions. In general, when the door sash is wide open, the damper is positioned for maximum airflow through the exhaust system and the damper is gradually closed in proportion to the closing of the door thus providing maximum airflow to maintain fumes in the hood when the door is open and minimum air flow when the door is closed and less exhaust is required to prevent fumes from entering the occupied area of the room containing the hood. While a positive airflow through the hood is always maintained regardless of the position of the door sash, the damper control minimizes the airflow when the door sash is closed and thus reduces heating or cooling requirements to maintain optimum conditions in the hood.

The damper control of this invention is actuated from a cable run between the door sash and a counterweight for the sash. In one embodiment the cable drives the control of a pneumatic positioning switch regulating airflow to a stroke type pneumatic motor which positions the damper in the exhaust system. This pneumatic type of damper actuation provides accurate incremental control of the position of the damper while holding the damper in its controlled position. Other arrangements for actuating the damper from the door sash counterbalancing cable, such as reduction gearing, control of electrical input to an electrical servo motor, and the like can be used.

It is then an object of this invention to provide an airflow control for laboratory fume hoods and the like apparatus having door equipped access openings to chambers receiving an airflow therethrough which is regulated by the degree of opening of the door.

Another object of this invention is to provide laboratory fume hoods having a continuous airflow therethrough with an airflow control that is automatically regulated by the degree of opening of the door.

A specific object of this invention is to provide a laboratory fume hood having a continuous airflow therethrough with a damper arrangement which increases the airflow as the door sash of the hood is opened.

Another specific object of this invention is to provide a laboratory fume hood with an automatic airflow control actuated from the run of a cable between the door sash and the counterweight for the door sash.

Other and further objects of this invention will become apparent to those skilled in this art from the following detailed description of the annexed sheets of drawings which, by way of preferred examples only, illustrated several embodiments of the invention:

BRIEF DESCRIPTION OF THE DRAWINGS

FIG. 3 is a broken fragmentary front cross-sectional view along the line III—III of FIG. 2.

FIG. 4 is a fragmentary horizontal cross-sectional view along the line IV—IV of FIG. 3.

FIG. 5 is a somewhat diagrammetic plan view of a cable actuated mechanical drive for the damper, according to this invention.

AS SHOWN ON THE DRAWINGS

Figure 1:
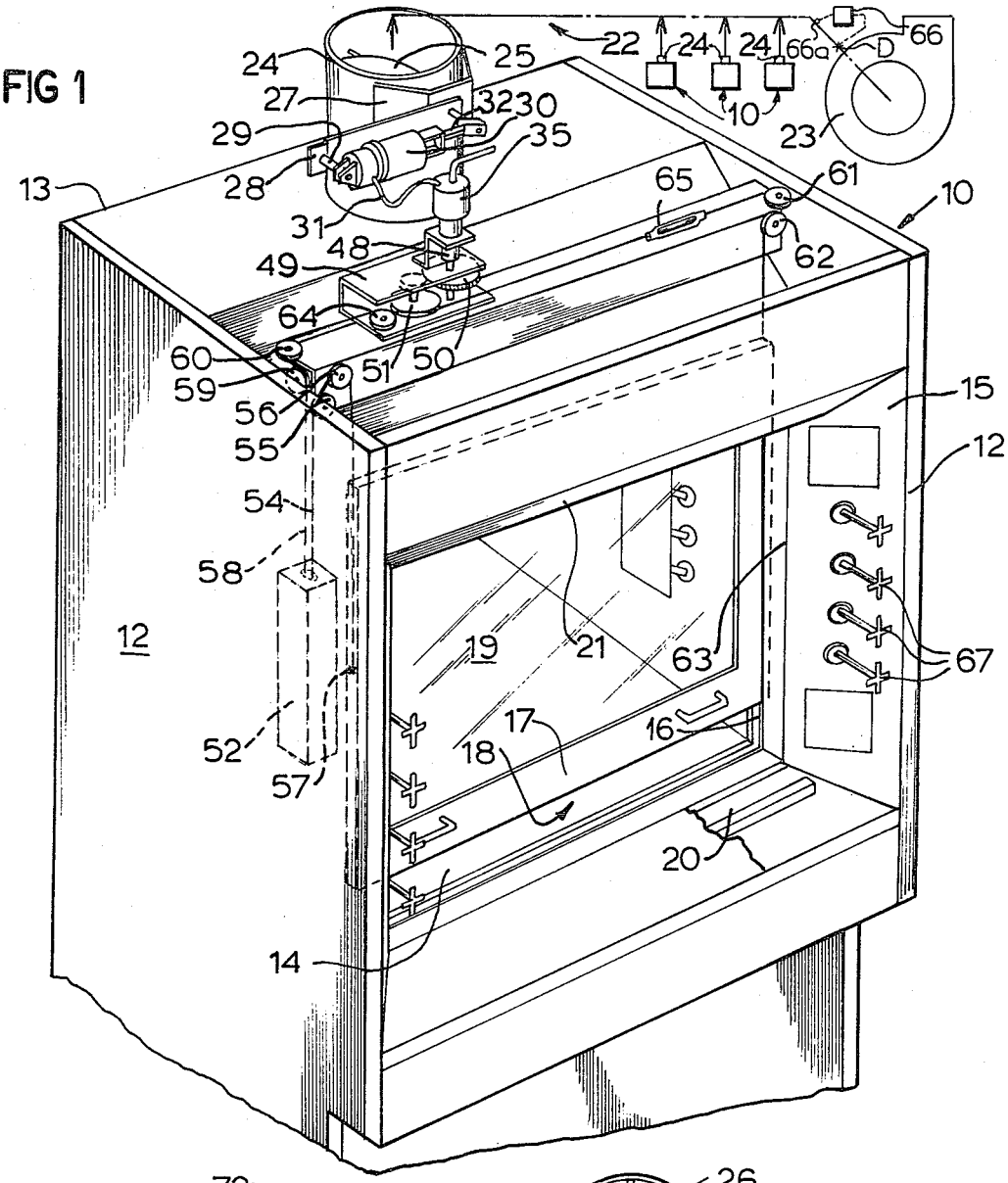
FIG. 1 is a side and front perspective view of a laboratory fume hood equipped with a sash controlled exhaust damper of this invention and with the lower portion of the hood structure omitted.

In FIGS. 1 through 4, the reference numeral 10 designates generally a rectangular cabinet composed of wood, metal, or the like construction material and having side walls 12, 12, a back wall 13, a bottom wall 14, and an open front surrounded by hollow facia 15, carrying vertical side channels such as 16 (FIG. 4) for a vertically slidable door or window sash 17 giving access to an enclosed compartment or chamber 18 providing the fume chamber or operating zone. The door sash 17 is preferably equipped with a transparent window pane 19.

Air is continuously circulated through the chamber or operating zone 18 even when the door sash 17 is closed and for this purpose access slots or openings 20 are provided under the bottom facia 15 and also through the top facia at 21 (FIG. 1) with the door sash 17 closing off the top inlet 21 when it is raised.

An exhaust ducting system shown diagrammetically at 22 in FIG. 1 has a single blower 23 servicing a plurality of fume hoods 10 through exhaust stack pipes such as 24, each of which extend from the top 13 of its respective hood or cabinet 10.

In accordance with this invention, the upright exhaust duct 24 on each fume hood 10 has a damper 25 secured on an axis shaft 26 rotatably mounted in the duct 24 with at least one end thereof projecting through a duct carried bracket 27 and rotatably supported bearings provided by the bracket. A plate 28 on this bracket carries a mounting pin 29 on which is swingably mounted the rear end of a stroke type pneumatic motor 30. This type of motor has a diaphragm exposed to air pressure from a supply tube 31 and positioning a piston rod 32 (FIG. 2) projecting therefrom against the bias of a coil spring 33 to accurately propel the piston rod for swinging an adjustable clamp 34 on the axle or shaft 26. The air pressure behind the diaphragm supplied from the tube 31 determines the power stroke of the motor 30 to rotate the damper 25 and to hold it in a fixed position in the duct 24.

Figure 6:
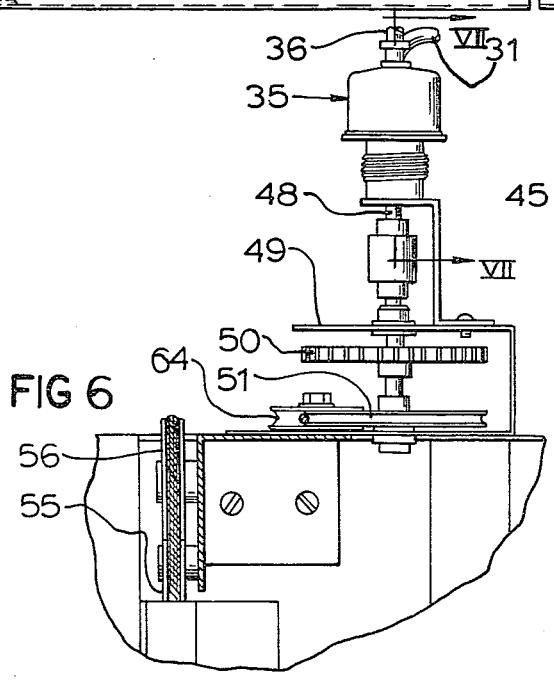
FIG. 6 is a vertical cross-sectional view along the line VI—VI of FIG. 2.
Figure 7:
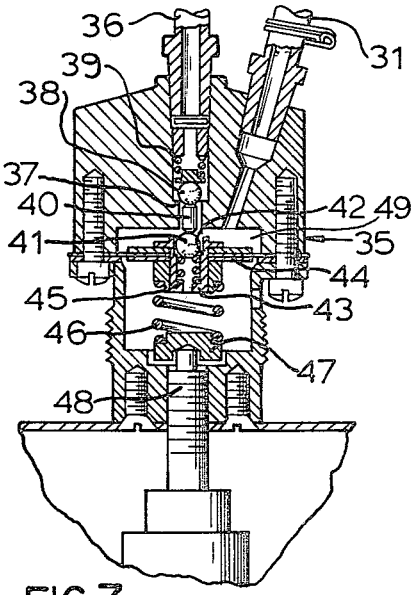
FIG. 7 is an enlarged cross-sectional view along the lines VII—VII of FIG. 6.

The air pressure or load on the diaphragm of the motor 30 is accurately controlled by a positioning switch 35 shown in FIGS. 6 and 7 delivering air gradually to the motor 36 so that no air is used except when the motor is to be driven. As there shown, air from a suitable pressure source is supplied to an inlet 36. A valve seat 37 in this inlet is closed by a supply valve ball 38 loaded against the seat by a spring 39. A push pin 40 downstream from the seat 37 rests on an exhaust valve ball 41 cooperating with a seat 42 in a valve body 43 which is supported by a diaphragm 44 and a spring 45 in the body 43 urges the valve ball 41 toward the pin 40. The diaphragm is biased by a spring 46 bottomed on a bushing 47 which in turn is bottomed on the pointed end of a screw rod 48. A chamber 49 above the diaphragm 44 communicates with the outlet to the tube 31.

The arrangement is such that the spring load on the diaphragm opposes the air pressure in the chamber 49 in positioning the exhaust valve ball 41. The spring load in turn is varied by the screw rod 48. When air pressure in chamber 49 exceeds spring pressure, the diaphragm 44 will be deflected permitting the valve 38 to close shutting off the air supply and at the same time permitting valve 41 to open just enough to balance the air pressure with the spring pressure. Conversely when the spring pressure is greater than the air pressure in the chamber 49 the valve 38 will be pushed open until the balance between the spring pressure and air pressure is obtained. Thus a very accurate control of the air load on the stroke motor is maintained.

The screw rod 48 is rotatably mounted in suitable bracket 49 carried from the top wall or roof 13 of the hood or cabinet 10 and is driven through a gear train 50 from a pulley 51.

The door sash 17 is counterbalanced by a rectangular weight 52 (FIGS. 3 and 4) slidable in a vertical guide 53 in the vertical facia 15 at the left side of the access opening to the chamber 18. A first cable 54 extends from the top of the weight 52 over pulleys 55 and 56 to a vertical run in the door guide channel 16 to be anchored to the door sash 17 at 57 about mid-way between the top and bottom end of the sash.

A second cable 58 extends from the top of the sash weight 52 around pulleys 59 and 60 to a horizontal run across the top of the cabinet 10 and thence around pulleys 61 and 62 to a vertical run through the opposite guide channel 16 for the door sash where it is anchored at 63 on the same level as the anchor 57. In its horizontal run across the top of the cabinet 10, the cable 58 is passed around a guide pulley 64 (FIGS. 1 and 2) to be held against the pulley 51. A turnbuckle 65 adjusts the length of the cable 58 to level the sash and operate freely in the guide channels 16.

The arrangement is such that when the sash 17 is raised and the counter weight 52 is lowered the cable will drive the pulley 51 to rotate the screw rod 48 thereby changing the load on the spring 46 of the positioning switch 35 and either admitting or exhausting air from the switch chamber 49 thereby actuating the stroke motor 30 to rotate the damper 25. The rotation is such that when the door sash 17 is raised the damper will be opened in some proportion (which need not be linear) to the degree of opening of the door from an adjusted closed position to an adjusted open position all as determined by the initial setting of the connecting link 34 on the shaft 26. The pneumatic motor control is powerful and accurate and will hold the damper in its adjusted position while being instantaneously responsive to opening and closing of the door.

The blower 23 servicing a number of units 10 may be driven at a constant speed and the air flow through each individual hood 10 will be regulated by each damper 25, the position of which is determined by the position of the access door to the hood. If a plurality of hoods are to be connected to a single exhaust system, provision is made to maintain a constant static pressure in the system regardless of the variation in quantity of air flowing through the system as determined by the variation in air flows through each hood. For this purpose, as illustrated in FIG. 1, a static pressure regulator 66 is connected to the inlet duct of the blower sensing the static pressure with a static pressure tap 66*a* actuating a power damper D located down stream of the static pressure tap 66*a*.

In some installations, the hood is equipped with knobs or handles such as 67 to control mechanical service outlets such as air, gas, water, etc., used as part of the experiment being performed in the hood.

In FIG. 5, an alternative first modification of the control of the damper 25 from the cable 58 is illustrated wherein the pulley 51 drives a gear reducer such as a worm drive 68 having a pulley 69 driving a cable 70 which in turn rotates a pulley 71 on the damper shaft 26. Rotation of the gear reducer in opposite directions by the pulley 51 will thus rotate the damper 25 in opposite directions.

Figure 8:
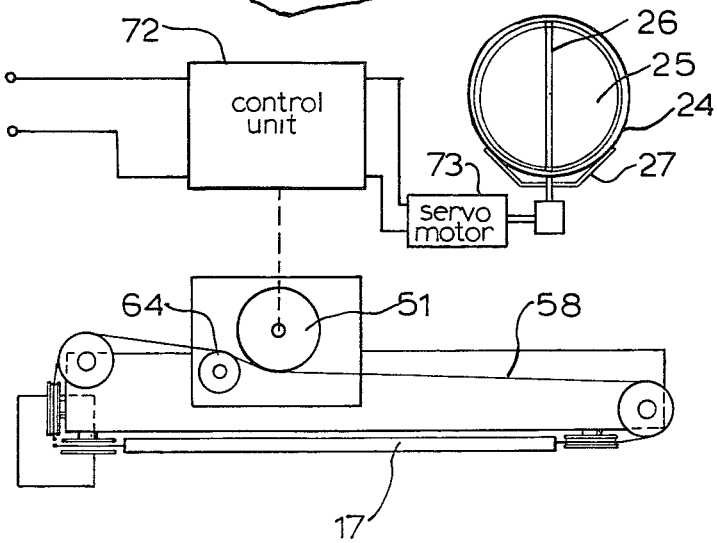
FIG. 8 is a diagrammetic view similar to FIG. 5 but illustrating a second modification of a cable actuated control for the damper, according to this invention.
Figure 2:
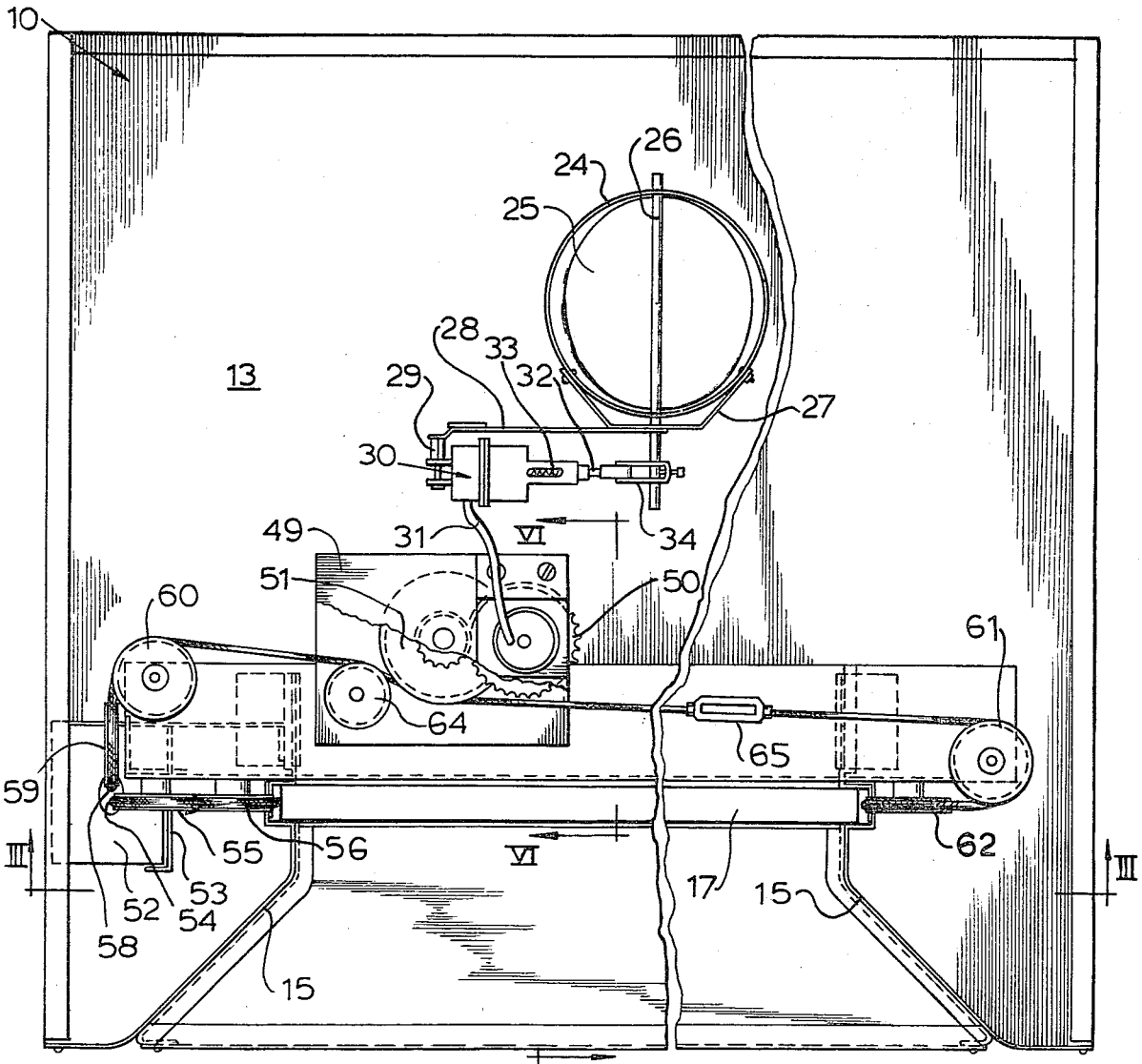
FIG. 2 is a broken top plan view of the hood of FIG. 1.

In another alternative arrangement, a second embodiment is illustrated in FIG. 8 wherein the cable 58 drives the pulley 51 as above explained and this pulley in turn activates a control unit 72 to an electric servo motor 73 coupled with the shaft 26 of the damper 25. The arrangement is such that when the door sash 17 is raised the servo motor will be energized in a direction to open the damper 25 and conversely, when the sash 17 is lowered the servo motor will operate in the opposite direction to close the damper 25.

From the above description it will therefore be understood that this invention provides an air flow control for laboratory hoods and the like structures having sash controlled access openings so that a desired air flow through the access opening is maintained at a minimum expenditure of energy.

I claim:

1. A laboratory fume hood which comprises a cabinet defining an enclosed working area with an access opening closed by a door, a by-pass air inlet effective to supply air to the working area when the door is closed and being progressively closed as the door is opened, means for continuously drawing air through the working area and exhausting the air remote from the fume hood, an air flow control means for said means continuously drawing air maintaining a constant static pressure with a flow rate variable between minimum and maximum flows, a damper controlling air flow from the working area, an air source, a stroke type pneumatic motor driving said damper, a positioning switch having a valve delivering air from said source to said motor only when the motor is to be driven, means biasing said valve of the positioning switch into closed position, and means controlled by the opening and closing of said door varying the loading of the biasing means to cause the positioning switch to open as the door is raised and to close as the door is lowered whereby the pneumatic motor will hold the damper in its adjusted position while being instantaneously responsive to opening and closing of the door and constant static pressure will be maintained regardless of the variation in quantity of air flowing through the working area.

* * * * *